US009518730B2

(12) United States Patent
Lu et al.

(10) Patent No.: US 9,518,730 B2
(45) Date of Patent: Dec. 13, 2016

(54) LARGE-SCALE CIRCULATING FLUIDIZED BED BOILER

(75) Inventors: Qinggang Lu, Beijing (CN); Ming Gao, Beijing (CN); Yunkai Sun, Beijing (CN); Guoliang Song, Beijing (CN); Xiaofang Wang, Beijing (CN); Yongjie Na, Beijing (CN); Dongyu Wang, Beijing (CN); Haigang Wang, Beijing (CN)

(73) Assignee: Institute of Engineering Thermophysics, Chinese Academy of Sciences, Beijing (CN)

( * ) Notice: Subject to any disclaimer, the term of this patent is extended or adjusted under 35 U.S.C. 154(b) by 525 days.

(21) Appl. No.: 13/983,008

(22) PCT Filed: Jan. 19, 2012

(86) PCT No.: PCT/CN2012/070574

§ 371 (c)(1),
(2), (4) Date: Aug. 20, 2013

(87) PCT Pub. No.: WO2012/103790

PCT Pub. Date: Aug. 9, 2012

(65) Prior Publication Data

US 2014/0299027 A1 Oct. 9, 2014

(30) Foreign Application Priority Data

Feb. 1, 2011 (CN) ..... 2011 1 0034335
May 27, 2011 (CN) ..... 2011 1 0140337

(51) Int. Cl.
*F22B 31/00* (2006.01)
*F23C 10/10* (2006.01)
(Continued)

(52) U.S. Cl.
CPC ..... *F22B 31/0084* (2013.01); *F23C 10/10* (2013.01); *F23C 10/18* (2013.01); *F23J 15/027* (2013.01); *F23J 2217/40* (2013.01)

(58) Field of Classification Search
CPC ..... F23C 10/08; F23C 10/10; F23J 15/027; F23J 2217/40
See application file for complete search history.

(56) References Cited

U.S. PATENT DOCUMENTS 4,951,612 A * 8/1990 Gorzegno ..... B01J 8/388 110/216
5,215,042 A * 6/1993 Beisswenger ..... B01J 8/386 110/245

(Continued)

*Primary Examiner* — David J Laux
(74) *Attorney, Agent, or Firm* — Davis Wright Tremaine LLP; Michael J. Donohue

(57) ABSTRACT

A large-size circulating fluidized bed boiler, comprising: a furnace having a vertical furnace center line; and at least two groups of cyclones, each cyclone of each group of cyclones having an inlet gas pass communicated with the furnace. A furnace cross section formed by outer sidewalls and located at the inlet gas pass of the cyclone is a polygon having 2×n sides, and n is a positive integer greater than 1. The polygon is axially symmetric with respect to a perpendicular bisector of each side of the polygon, and when n is 2, the polygon is a square. Triangles formed by two endpoints of an inlet of the inlet gas pass of each cyclone at the cross section and an intersection of the furnace center line and the cross section are congruent. A single flow field in communication with each of the inlet is formed in the cross section.

12 Claims, 4 Drawing Sheets

(51) Int. Cl.
*F23J 15/02* (2006.01)
*F23C 10/18* (2006.01)

(56) References Cited

U.S. PATENT DOCUMENTS

| | | | | |
|---|---|---|---|---|
| 5,678,497 | A * | 10/1997 | Goidich | F23C 10/02 110/245 |
| 6,802,890 | B2 * | 10/2004 | Hyppanen | B01D 45/12 422/146 |
| 7,244,400 | B2 * | 7/2007 | Darling | F22B 31/003 122/6 A |
| 2005/0092219 | A1 * | 5/2005 | Enault | F23C 10/005 110/245 |
| 2005/0112037 | A1 * | 5/2005 | Darling | F22B 31/003 422/139 |

* cited by examiner

LARGE-SCALE CIRCULATING FLUIDIZED BED BOILER

This application is the United States National Phase of International Application PCT/CN2012/070574, filed Jan. 19, 2012. This application also includes a claim of priority to Chinese Application No. 201110140337.9 filed May 27, 2011 and Chinese Application No. 201110034335.1 filed Feb. 1, 2011.

FIELD OF THE INVENTION

The present invention relates to a circulating fluidized bed boiler, more particularly, relates to a large-size circulating fluidized bed boiler.

DESCRIPTION OF THE RELATED ART

With the scaling up of a circulating fluidized bed boiler, an area of furnace cross section is increased, a quantity of circulating material and flue gas is also increased, and more and more cyclones are needed. When a plurality of cyclones are arranged in parallel, a uniform flue gas flow rate is needed for each of the cyclones, otherwise a fluid field and a temperature in the furnace and its backpass become uneven, it reduces the separation efficiency of the cyclones, and has a bad effect on the combustion efficiency, the discharge control of the pollutant, and the operation of the circulating circuit. At the same time, since the area of the furnace cross section is increased, the distance between a secondary air outlet in a side wall of the furnace and the center region of the furnace becomes longer. Accordingly, it is difficult for the secondary air to reach the center region of the furnace, and also has a bad effect on the combustion efficiency, the discharge control of the pollutant, and so on.

So far, a usual solution to solve the above problems is to continuously increase a ratio of a width to a depth of the furnace, so that a rectangular furnace cross section becomes flatter and flatter. The cyclones are often arranged in parallel along two long sides of the furnace cross section. A Chinese patent application No. 201010162777.X discloses a solution in which the cyclones are axially symmetric or centrosymmetric with respect to a center point of the furnace to solve an uneven problem caused by the arrangement of the plurality of cyclones. However, it is rather hard to design this solution and a rich experience on the arrangement design of the cyclones is needed.

SUMMARY OF THE INVENTION

The present invention has been made to overcome or alleviate at least one aspect of the above mentioned disadvantages.

According to an aspect of the present invention, there is provided a large-size circulating fluidized bed boiler, comprising: a furnace having a vertical furnace center line; and at least two groups of cyclones, each cyclone of each group of cyclones having an inlet gas pass communicated with the furnace, wherein a furnace cross section formed by outer sidewalls at the inlet gas pass of the cyclone is a polygon having 2×n sides, and n is a positive integer greater than 1; wherein the polygon is axially symmetric with respect to a perpendicular bisector of each side of the polygon, and when n is 2, the polygon is a square; wherein triangles formed by two endpoints of an inlet of the inlet gas pass of each cyclone at the cross section and an intersection of the furnace center line and the cross section are congruent; and wherein a single flow field in communication with each of the inlet is formed in the cross section.

Preferably, the at least two groups of cyclones are arranged by a same interval angle about the furnace center line; and wherein the respective sides of the cross section at the respective groups of cyclones are equal to each other.

Furthermore, the at least two groups of cyclones at least comprises a pair of groups of cyclones; and when n is an even number, the pair of groups of cyclones are arranged on the respective sides having a common perpendicular bisector, respectively, in the furnace cross section.

Optionally, each group of the pair of groups of cyclones comprises one cyclone. Preferably, the inlet gas pass of one cyclone of the pair of groups of cyclones and the inlet gas pass of the other cyclone of the pair of groups of cyclones are centrosymmetric in the cross section with respect to the intersection of the furnace center line and the cross section.

Optionally, each group of the pair of groups of cyclones comprises two cyclones. Preferably, the inlet gas passes of the two cyclones of each group of cyclones are axially symmetric in the cross section with respect to the perpendicular bisector of the respective side. Furthermore, in the cross section, the two cyclones of each group of cyclones are arranged back to back and close to each other on the respective side. Alternatively, in the cross section, the two cyclones of each group of cyclones are arranged opposite to each other at locations of the respective side adjacent to corners of the furnace, respectively.

Optionally, n is an odd number; and wherein the at least two groups of cyclones comprises three groups of cyclones or six groups of cyclones.

Optionally, the at least two groups of cyclones comprises three groups of cyclones with each group having one cyclone.

Optionally, the at least two groups of cyclones comprises three groups of cyclones with each group having two cyclones. Preferably, the inlet gas passes of the two cyclones of each group of cyclones are axially symmetric in the cross section with respect to the perpendicular bisector of the respective side. Furthermore, in the cross section, the two cyclones of each group of cyclones are arranged back to back and close to each other on the respective side. Alternatively, in the cross section, the two cyclones of each group of cyclones are arranged opposite to each other at locations of the respective side adjacent to corners of the furnace, respectively.

Preferably, the large-size circulating fluidized bed boiler further comprises a water cooling column disposed at the furnace center line and extending from an air distributor to a ceiling, wherein the outer sidewalls of the furnace, the water cooling column, the ceiling and the air distributor together enclose a furnace combustion space; and wherein the water cooling column is a column surface formed by enclosing water walls, the water cooling column is provided with secondary air ports through which secondary air from an internal space of the water cooling column enters into the furnace.

Preferably, in the furnace cross section, the cross section of the water cooling column is axially symmetric with respect to the perpendicular bisector of each side of the polygon.

Preferably, the cross sections of the water cooling column in each of the congruent triangles have a congruent shape.

Preferably, the number of sides of a polygon formed by the cross section of the water cooling column is one half, one time or twice as much as the number of sides of the polygon formed by the furnace cross section.

Preferably, an expanded heating surface is provided on side surfaces of the water cooling column toward the furnace combustion space. The expanded heating surface may be platen superheaters, platen reheaters or water wall panels.

Preferably, if there is an outer sidewall where the cyclone is not arranged, and then expanded heating surfaces are provided on a side surface of the outer sidewall toward the furnace combustion space. The expanded heating surfaces are platen superheaters, platen reheaters or water wall panels.

BRIEF DESCRIPTION OF THE DRAWINGS

The above and other features of the present invention will become more apparent by describing in detail exemplary embodiments thereof with reference to the accompanying drawings, in which.

Figure 1:
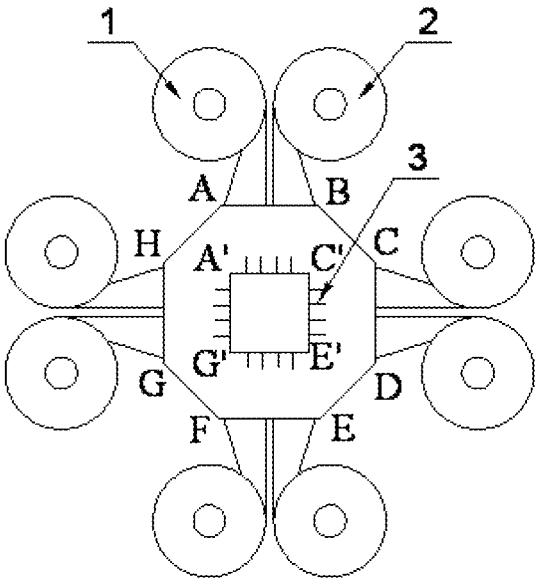
FIG. 1 is an illustrative top view of a large-size circulating fluidized bed boiler according to an exemplary embodiment 1 of the present invention.

In the above drawings, the front views only show a shape of a furnace and inlet gas passes of a cyclone, and do not show the cyclone, a loop-seal and backpass.

DETAILED DESCRIPTION OF PREFERRED EMBODIMENTS OF THE INVENTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

A large-size circulating fluidized bed boiler according to the present invention comprises a furnace, a cyclone, a loop-seal and a backpass communicated with each other. In addition, the large-size circulating fluidized bed boiler according to the present invention may also comprise an external heat exchanger, and so on. The furnace is enclosed by outer sidewalls of the furnace, an air distributor and a ceiling, and may also comprise a water cooling column disposed at a furnace center line.

The large-size circulating fluidized bed boiler according to the present invention comprising: a furnace having a vertical furnace center line; and at least two groups of cyclones, each cyclone of each group of cyclones having an inlet gas pass communicated with the furnace, wherein a furnace cross section formed by outer sidewalls and located at the inlet gas pass of the cyclone is a polygon having 2×n sides, and n is a positive integer greater than 1; wherein the polygon is axially symmetric with respect to a perpendicular bisector of each side of the polygon, and when n is 2, the polygon is a square; wherein a triangle formed by two endpoints of an inlet of the inlet gas pass of each cyclone at the cross section and an intersection of the furnace center line and the cross section is congruent; and wherein a single flow field in communication with each of the inlet is formed in the cross section.

It is appreciated for those skilled in this art that the term 'single flow field' herein indicates a flow field that is not divided into a plurality of flow fields in a plane of the cross section, that is, the cross section is not divided into a plurality of sub-blocks that are not fluidly communicated with each other in the plane of the cross section.

Please be noted that the internal space enclosed by the water cooling column is not a portion of the furnace in case the water cooling column is disposed inside the furnace because a flue gas does not pass through the internal space enclosed by the water cooling column.

The term 'furnace center line' herein indicates a longitudinal center line of the furnace. For example, in the cross section shown in drawings, the longitudinal center line of the furnace exhibits a geometrical center of the cross section. The solution of the present invention discards the conventional furnace structure having a flat rectangular cross section, and improves the upper flow field uniformity of the furnace and the flow rate distribution uniformity of the flue gas entering into the respective cyclones.

Although in the furnace shown in each draw the water cooling column is disposed, there may be no water cooling column in the furnace.

As shown in FIGS. 1-17, the at least two groups of cyclones are arranged by an even interval angle about the furnace center line; and the respective sides of the cross section at the respective groups of cyclones are equal to each other.

Figure 3:
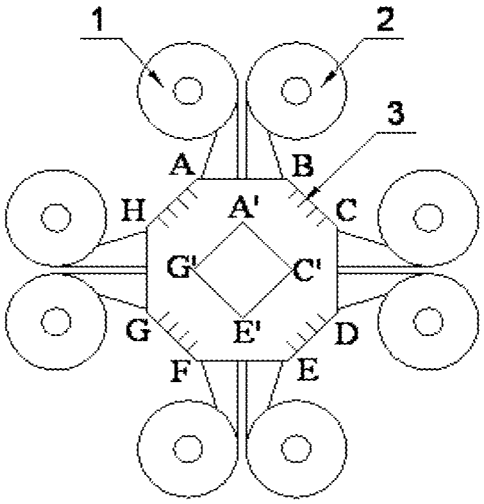
FIGS. 3, 4, 5 and 6 are illustrative top views of optional examples according to the embodiment 1 of the present invention, respectively.
Figure 4:
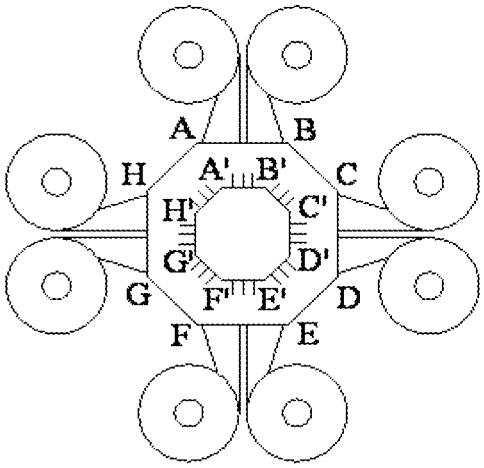
Figure 5:
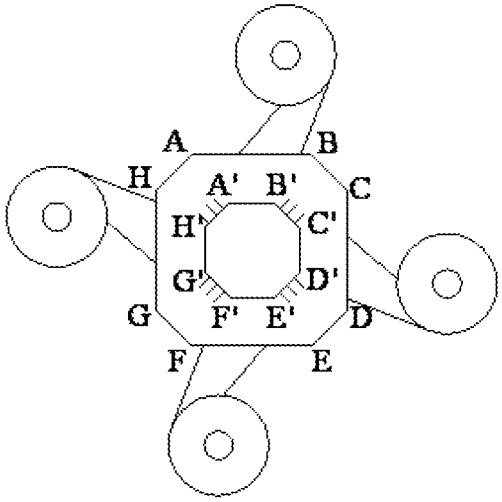
Figure 9:
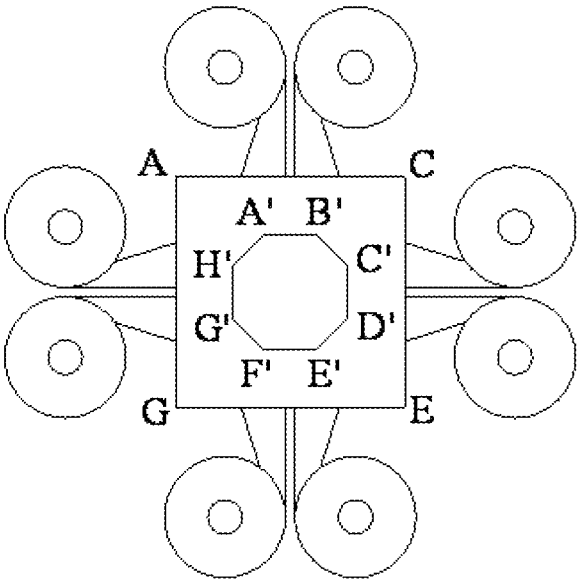
FIGS. 9, 10, 11, 12 and 13 are illustrative top views of optional examples according to the embodiment 2 of the present invention, respectively.
Figure 10:
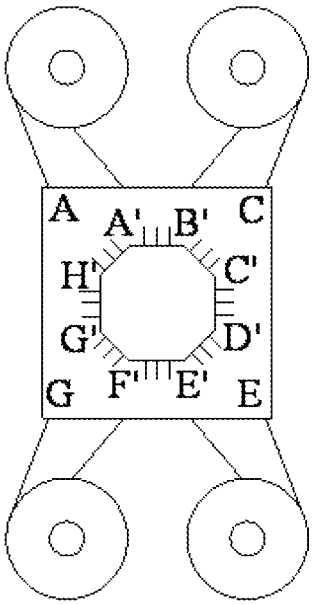

As shown in FIGS. 1, 3-7, 9-13, the at least two groups of cyclones at least comprises a pair of groups of cyclones; and when n is an even number, the pair of groups of cyclones are arranged on the respective sides having a common perpendicular bisector, respectively, in the furnace cross section. Herein, the feature "at least comprises a pair of groups of cyclones" indicates that the at least two groups of cyclones may comprise one pair of groups of cyclones (as shown in FIG. 10), or comprise two or more pairs of groups of cyclones (as shown in FIG. 5).

Figure 12:
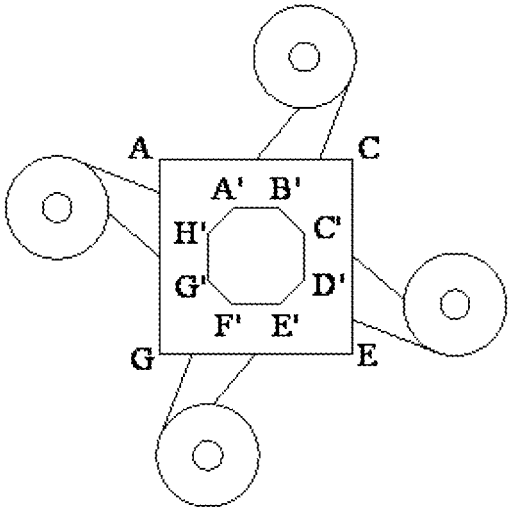
Figure 13:
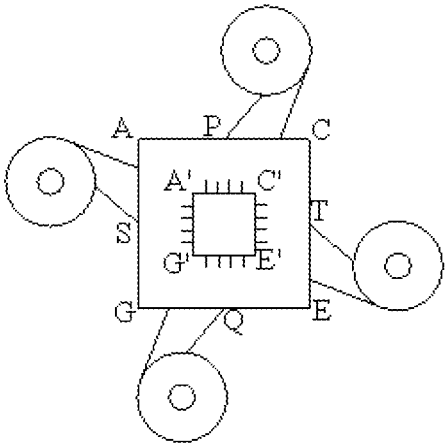

Furthermore, as shown in FIGS. 5-6, 12-13, each group of the pair of groups of cyclones comprises one cyclone. Preferably, the inlet gas pass of one cyclone of the pair of groups of cyclones and the inlet gas pass of the other cyclone of the pair of groups of cyclones are centrosymmetric in the cross section with respect to the intersection of the furnace center line and the cross section. For example, as shown in FIG. 13, a distance AP from an inside start point P of the inlet gas pass of the cyclone at an upper side of FIG. 13 to a corner point A of a furnace outer sidewall, a distance EQ from an inside start point Q of the inlet gas pass of the cyclone at a lower side of FIG. 13 to a corner point E of a furnace outer sidewall, a distance CT from an inside start point T of the inlet gas pass of the cyclone at a right side of FIG. 13 to a corner point C of a furnace outer sidewall, and a distance GS from an inside start point S of the inlet gas pass of the cyclone at a left side of FIG. 13 to a corner point G of a furnace outer sidewall are equal to each other. The above design can effectively achieve a uniform flow rate distribution for the inlet gas pass of each cyclone. The above descriptions and effects can be similarly applied in other arrangements of the present invention.

Figure 11:
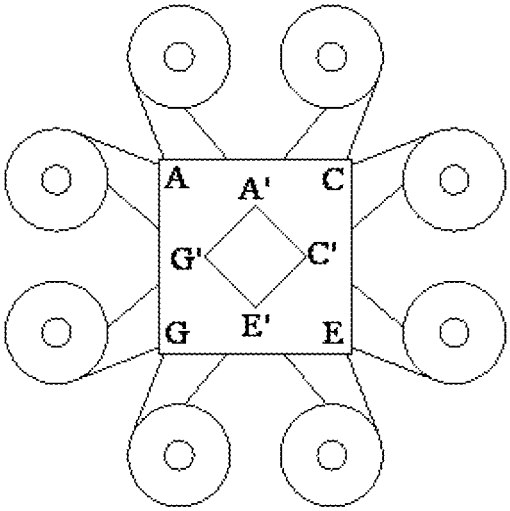

In another embodiment of the present invention, as shown in FIGS. 1, 3-4, 7, 9 and 11, each group of the pair of groups of cyclones comprises two cyclones. Preferably, the inlet gas passes of the two cyclones of each group of cyclones are axially symmetric in the cross section with respect to the perpendicular bisector of the respective side. As shown in FIGS. 1-2, 4, 7 and 9, in the cross section, the two cyclones of each group of cyclones are arranged back to back and close to each other on the respective side, that is, outer sides of the inlet gas passes of the two cyclones are adjacent to each other and close to a center of the sidewall, and at the same time, inner sides of the inlet gas passes of the two cyclones face toward two corners of the outer sidewall. Alternatively, as shown in FIG. 11, in the cross section, the two cyclones of each group of cyclones are arranged opposite to each other at locations of the respective side adjacent to corners of the furnace, respectively, that is, inner sides of the inlet gas passes of the two cyclones are opposite to each other, and at the same time, outer sides of the inlet gas passes of the two cyclones face toward two corners of the outer sidewall.

In an exemplary embodiment of the present invention, n may be an odd number, and the at least two groups of cyclones comprises three groups of cyclones or six groups of cyclones.

Figure 17:
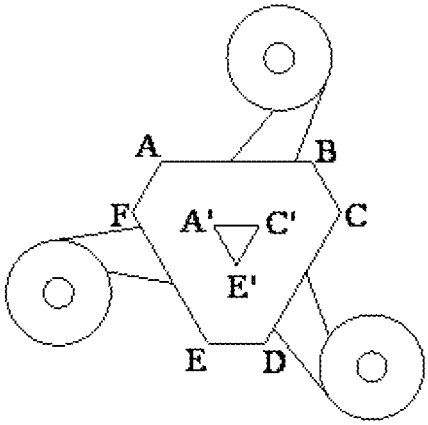

As shown in FIG. 17, the at least two groups of cyclones comprises three groups of cyclones with each group having one cyclone.

Figure 14:
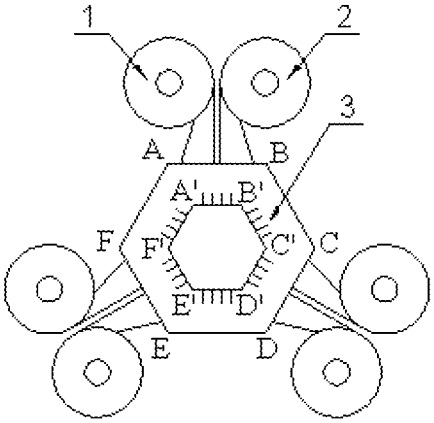
FIG. 14 is an illustrative top view of a large-size circulating fluidized bed boiler according to an exemplary embodiment 3 of the present invention.
Figure 15:
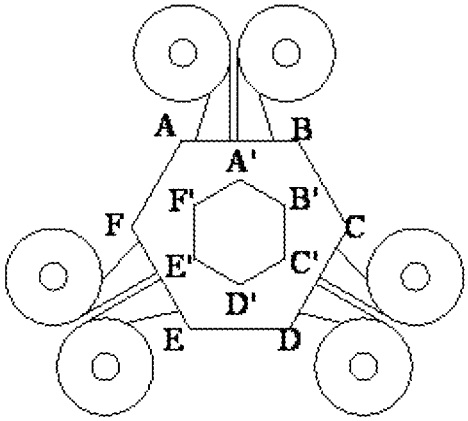
FIGS. 15, 16 and 17 are illustrative top views of optional examples according to the embodiment 3 of the present invention, respectively.
Figure 16:
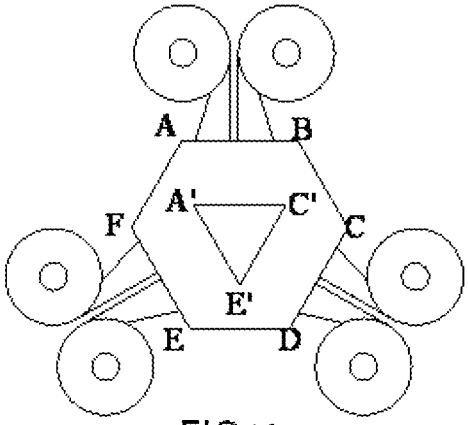

As shown in FIGS. 14-16, the at least two groups of cyclones comprises three groups of cyclones with each group having two cyclones. Preferably, the inlet gas passes of the two cyclones of each group of cyclones are axially symmetric in the cross section with respect to the perpendicular bisector of the respective side. As shown in FIGS. 14-16, in the cross section, the two cyclones of each group of cyclones are arranged back to back and close to each other on the respective side. Alternatively, if there is a sufficient space, in the cross section, the two cyclones of each group of cyclones are arranged opposite to each other at locations of the respective side adjacent to corners of the furnace, respectively.

Optionally, the large-size circulating fluidized bed boiler according to an embodiment of the present invention may further comprise a water cooling column disposed at the furnace center line and extending from an air distributor to a ceiling. The outer sidewalls of the furnace, the water cooling column, the ceiling and the air distributor together enclose a furnace combustion space; and the water cooling column is a column surface formed by enclosing water walls, the water cooling column is provided with secondary air ports through which secondary air from an internal space of the water cooling column enters into the furnace. The top and bottom ends of the water cooling column may be communicated with the external atmosphere. The secondary air may enter into the furnace through the secondary air ports via an air pipe individually arranged inside the water cooling column. The top and bottom ends of the water cooling column may be closed, and the internal space of the water cooling column may be directly served as a secondary air passage through which the secondary air enters into the furnace via the secondary air ports. Also, secondary air ports may be provided in the furnace outer sidewall.

The cross section of the water cooling column exhibits a polygon mated with the shape of the cross section of the furnace outer sidewall. Preferably, in the furnace cross section, the cross section of the water cooling column is axially symmetric with respect to the perpendicular bisector of each side of the polygon. In this way, internal spaces of the furnace corresponding to the inlet gas passes of the cyclones are completely the same as each other. It can effectively achieve a uniform flow rate distribution of the flue gas among the plurality of cyclones arranged in parallel in case the water cooler column is provided in the furnace.

The number of sides of a polygon formed by the cross section of the water cooling column may be one half, one time or twice as much as the number of sides of the polygon formed by the furnace cross section. For example, the cross section of the furnace outer sidewall is a square; the cross section of the water cooling column is a square or an octagon. Alternatively, the cross section of the furnace outer sidewall is an octagon; the cross section of the water cooling column is a square or an octagon. Alternatively, the cross section of the furnace outer sidewall is a hexagon; the cross section of the water cooling column is a hexagon or an equilateral triangle.

Preferably, expanded heating surfaces are provided on side surfaces of the water cooling column toward the furnace combustion space. Optionally, the expanded heating surfaces may be provided on a portion of the side surfaces of the water cooling column toward the furnace combustion space. Furthermore, the expanded heating surfaces may be platen superheaters, platen reheaters or water wall panels.

Optionally, if there is an outer sidewall where the cyclone is not arranged, and then expanded heating surfaces may be provided on a side surface of the outer sidewall toward the furnace combustion space. The expanded heating surfaces may be platen superheaters, platen reheaters or water wall panels.

In recent years, the furnace of the conventional circulating fluidized bed boiler always has a flat rectangular cross section, particularly, as the boiler becomes large-size. The above prior technology focuses on a conventional solution to increase a ratio of a width to a depth of the furnace so that the rectangular furnace cross section becomes flatter and flatter. The large-size circulating fluidized bed boiler according to the present invention break through the conventional solution. A gist of the design of the furnace having a large-size cross section is how to achieve a uniform flow rate of the cyclones communicated with the furnace. The present invention can achieve the above object by improving the uniformity of the upper flow field of the furnace and arranging the cyclones in a completely symmetrical manner.

In fact, a gas-solid flow in the furnace is constantly pulsed and is not uniform every moment. However, if a region where the gas-solid flow is insufficient can be quickly compensated by the gas-solid flow in a surrounding region, then the fluid field can be self-balanced in the furnace and can achieve a uniform fluid field in a macroscopic space and a continuous time. The gist of this compensation is to shorten the flow compensation path as short as possible, that is, a distance between any two points on the furnace cross section should be as short as possible. Accordingly, if the furnace cross section is more approximate to a circle, this compensation is better. However, it is hard to machine, manufacture and mount a circle furnace. Therefore, in the practice, a furnace having a polygon shape that is approximate to the circle as a whole, for example, a square, a regular hexagon and similar shape, a regular octagon and similar shape, etc., is often used.

The internal space of the furnace corresponding to the cyclones determines the flow rate of the flue gas flowing into therein to a great extent. When cyclones are juxtaposed, a completely symmetrical arrangement may further ensure a uniform flue gas flow rate of the respective cyclones. Accordingly, the present invention also breaks through an arrangement solution of the conventional cyclones where the cyclones are arranged on only two opposite sidewalls of the furnace. In the present invention, the cyclones may be arranged around the furnace, which greatly improves the flow distribution uniformity when the cyclones are juxtaposed.

By providing the water cooling column in the center of the furnace of the circulating fluidized bed boiler, the secondary air not only can be injected into the furnace from the furnace outer sidewall, but also can be injected into the furnace form the center of the furnace, therefore, the width and depth of the furnace is not limited by the penetration depth of the secondary air. Therefore, the cross section shape of the furnace of a large-size circulating fluidized bed boiler can even be a polygon approximate to a circle as a whole, instead of a flat rectangular cross section like the conventional furnace. Furthermore, the water cooling column can greatly increase the area of the water cooling surface of the furnace without increasing the area of the furnace cross section, therefore, it can compensate the reduction of the area of the furnace outer sidewall due to the shape of the furnace cross section approximate to a square, so that a furnace having a square cross section is possible in practice, and the height of the furnace and the cost of manufacturing the boiler can be decreased.

The cross section of the furnace outer sidewall may be a square, a regular hexagon, a regular octagon, or an octagon formed by a square with four same corner cuts of 135 degrees, a hexagon formed by a regular triangle with three same corner cuts of 120 degrees, and so on. Also, the cross section of the furnace outer sidewall may be other shapes approximate to the circle as a whole.

Furthermore, an expanded heating surface may be arranged on the inside of the furnace outer sidewall and the outside of the water cooling column, in this way, locations adapted to arrange the expanded heating surface thereon are more than the conventional rectangular furnace.

Hereafter, the present invention according to embodiments will be described by reference to drawings.

Embodiment 1

Figure 2:
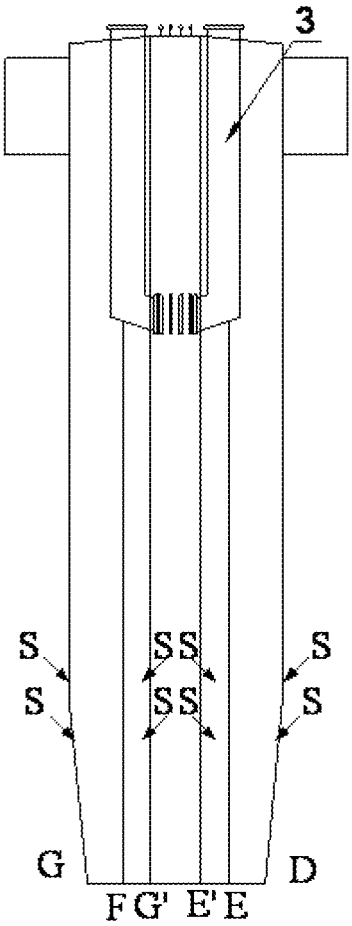
FIG. 2 is an illustrative front cross section view of a large-size circulating fluidized bed boiler according to an exemplary embodiment 1 of the present invention.

FIGS. 1-2 show a large-size circulating fluidized bed boiler. As shown in FIGS. 1-2, a cross section of a furnace formed by outer sidewalls at a joint of an upper portion of the furnace to cyclones, that is, at an inlet gas pass of the cyclone, is a regular octagon ABCDEFGH. A cross section of a water cooling column disposed at a center line of the furnace is a square A'C'E'G'. Sides AB, CD, EF, GH are parallel to sides A'C', C'E', E'G', G'A', respectively. The outer sidewall and the water cooling column both are constituted by water walls, and a furnace combustion space is formed between the outer sidewall and the water cooling column. Four groups of cyclones are symmetrically arranged outside the four outer sidewalls AB, CD, EF, GH of the furnace. Each group of cyclones comprises two cyclones 1, 2. The two cyclones 1, 2 of each group of cyclones are arranged back to back on a same sidewall. A side of the water cooling column toward the furnace combustion space is arranged with expanded heating surfaces 3. The top and bottom of the water cooling column are closed, and the internal space of the water cooling column is directly served as a secondary air passage. Two layers of secondary air ports S are provided in a lower portion of the water cooling column for injecting the secondary air into the furnace.

Optionally, the outer sidewalls may be arranged with only two groups of cyclones, for example, two groups of cyclones having four cyclones are arranged only on the outer sidewalls AB and EF.

Optionally, the upper furnace cross section may not be a regular octagon, but an octagon formed by a square with four same corner cuts of 135 degrees, and four sides AB, CD, EF, GH of the octagon formed by the square are equal to each other, and the other four sides BC, DE, FG, HA of the octagon formed by the square are equal to each other.

Figure 6:
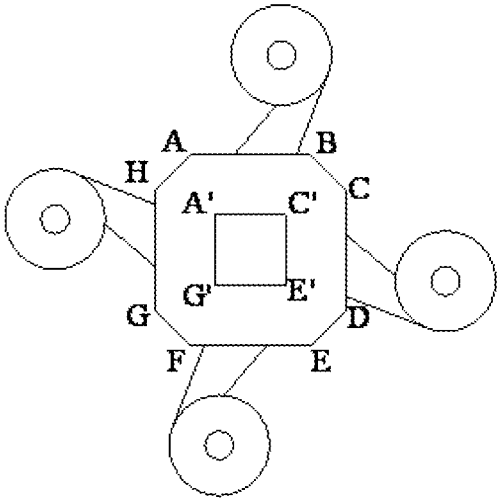

Optionally, in this embodiment, four sides AB, CD, EF, GH of the outer sidewalls of the furnace may form an angle of 45 degrees relative to four sides A'C', C'E', E'G', G'A' of the water cooling column, respectively, as shown in FIG. 3. The cross section of the water cooling column may be a regular octagon, as shown in FIGS. 4-5. Each of the outer sidewalls may be arranged with only a single cyclone, as shown in FIG. 6.

The expanded heating surfaces 3 may be further provided inside the heart outer sidewalls as shown in FIG. 3. The expanded heating surfaces 3 may be steam cooling panels, for example, platen superheaters, platen reheaters, etc., and may be water wall panels that may extend from the bottom to the top of the furnace.

Embodiment 2

Figure 7:
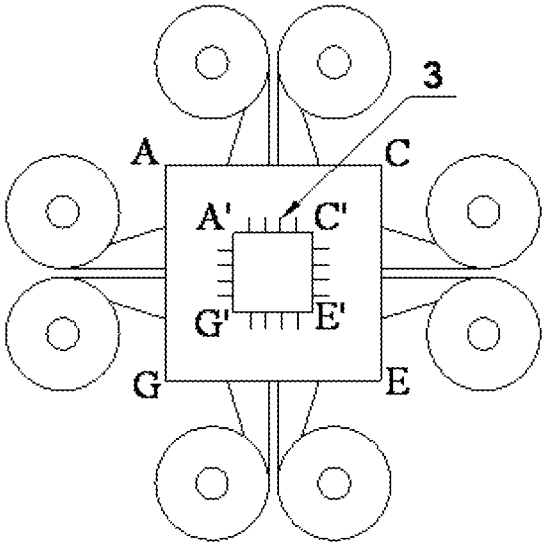
FIG. 7 is an illustrative top view of a large-size circulating fluidized bed boiler according to an exemplary embodiment 2 of the present invention.
Figure 8:
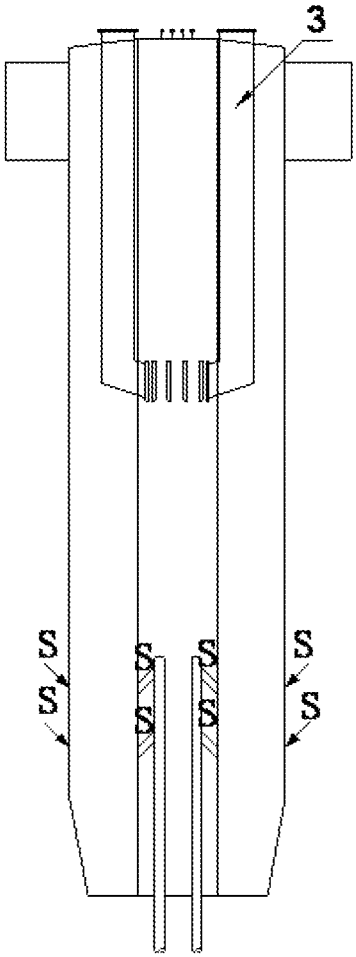
FIG. 8 is an illustrative front cross section view of a large-size circulating fluidized bed boiler according to an exemplary embodiment 2 of the present invention.

FIGS. 7-8 show a large-size circulating fluidized bed boiler. As shown in FIGS. 7-8, a cross section of a furnace formed by outer sidewalls at a joint of an upper portion of the furnace to cyclones is a square ACEG. A cross section of a water cooling column disposed at a center line of the furnace is a square A'C'E'G'. Sides AC, CE, EG, GA of the outer sidewalls are parallel to sides A'C', C'E', E'G', G'A' of the water cooling column, respectively. Four groups of cyclones are symmetrically arranged outside the four outer sidewalls AC, CE, EG, GA of the furnace. Each group of cyclones comprises two cyclones 1, 2. The two cyclones 1, 2 of each group of cyclones are arranged back to back on a same sidewall. A side of the water cooling column toward the furnace combustion space is arranged with expanded heating surfaces 3. The top and bottom of the water cooling column are not closed, and an individual air pipe is arranged inside the water cooling column and communicated with secondary air ports S in the sidewall of the water cooling column for injecting secondary air into the furnace.

Optionally, in this embodiment, the cross section of the water cooling column may be a regular octagon, as shown in FIGS. 9-10, or may be an octagon formed by a square with four same corner cuts of 135 degrees.

Optionally, the cyclones on each sidewall may be arranged opposite to each other and adjacent to corners of the furnace. The cyclones may be only arranged on two opposite sidewalls of the furnace outer sidewalls, for example, on the sidewall AC and the sidewall GE, as shown in FIG. 10. Each of the four outer sidewalls of the furnace may be arranged with one group of cyclones, as shown in FIG. 11.

Optionally, four sides AC, CE, EG, GA of the outer sidewalls of the furnace may form an angle of 45 degrees relative to four sides A'C', C'E', E'G', G'A' of the water cooling column, respectively, as shown in FIG. 11.

Optionally, one sidewall of the outer sidewalls may be arranged with only a single cyclone, as shown in FIGS. 12-13.

Embodiment 3

FIGS. 14-15 show a large-size circulating fluidized bed boiler. As shown in FIGS. 14-15, a cross section of a furnace formed by outer sidewalls at a joint of an upper portion of the furnace to cyclones is a regular hexagon ABCDEF. A cross section of a water cooling column disposed at a center line of the furnace also is a regular hexagon A'B'C'D'E'F'. Sides AB, BC, CD, DE, EF, FA of the outer sidewalls are parallel to sides A'B', B'C', C'D', D'E', E'F', F'A' of the water cooling column, respectively. Three groups of cyclones are symmetrically arranged outside three outer sidewalls AB, CD, EF of the furnace. Each group of cyclones comprises two cyclones 1, 2. The two cyclones 1, 2 of each group of cyclones are arranged back to back on a same sidewall. A side of the water cooling column toward the furnace combustion space is arranged with expanded heating surfaces 3 and is provided with secondary air ports S at a lower portion thereof.

Optionally, in this embodiment, six sides AB, BC, CD, DE, EF, FA of the outer sidewalls of the furnace may form an angle of 60 degrees relative to six sides A'B', B'C', C'D', D'E', E'F', F'A' of the water cooling column, respectively, as shown in FIG. 15. The cross section of the water cooling column may be a regular triangle, as shown in FIG. 16. The cross sections of the furnace and the water cooling column are both a hexagon and the sides of the furnace cross section are parallel with sides of the water cooling column respectively, in this case, one sidewall of the outer sidewalls may be arranged with only a single cyclone, as shown in FIG. 17.

Optionally, the furnace cross section may be a hexagon formed by a regular triangle with three same corner cuts of 120 degrees, and the cross section of the water cooling column may be a regular triangle, as shown in FIG. 17.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A large-size circulating fluidized bed boiler, comprising:

a furnace having a vertical furnace center line; and at least two groups of cyclones, each cyclone of each group of cyclones having an inlet gas pass communicated with the furnace, wherein a furnace cross section formed by outer sidewalls at the inlet gas pass of the cyclone is a polygon having 2×n sides, and n is a positive integer greater than 1;

wherein the polygon is axially symmetric with respect to a perpendicular bisector of each side of the polygon, and when n is 2, the polygon is a square;

further comprising:

a water cooling column disposed at the furnace center line and extending from an air distributor to a ceiling, wherein the outer sidewalls of the furnace, the water cooling column, the ceiling and the air distributor together enclose a furnace combustion space; and wherein the water cooling column is a column surface formed by enclosing water walls;

wherein a single flow field in communication with each of an inlet of the inlet gas pass of each cyclone is formed in the cross section, the single flow field indicates that the cross section is not divided into a plurality of sub-blocks that are not fluidly communicated with each other in the plane of the cross section;

wherein the at least two groups of cyclones are arranged by a same interval angle about the furnace line; and wherein the respective sides of the cross section at the respective groups of cyclones are equal to each other, wherein outer sides of the inlet gas passes of two cyclones of each group of cyclones are adjacent to each other and close to a center of the respective outer sidewall, and inner sides of the inlet gas passes of two cyclones of each group of cyclones face toward two corners of the outer sidewall, the cross section of the water cooling column exhibits a polygon mated with the shape of the cross section of the furnace outer sidewalls, wherein the number of sides of the polygon formed by the cross section of the water cooling column is equal to the number of sides of the polygon formed by the furnace cross section.

2. The large-size circulating fluidized bed boiler according to claim 1, wherein the at least two groups of cyclones at least comprises a pair of groups of cyclones; and when n is an even number, the pair of groups of cyclones are arranged on the respective sides having a common perpendicular bisector, respectively, in the furnace cross section.

3. The large-size circulating fluidized bed boiler according to claim 2, wherein each group of the pair of groups of cyclones comprises two cyclones.

4. The large-size circulating fluidized bed boiler according to claim 3, wherein the inlet gas passes of the two cyclones of each group of cyclones are axially symmetric in the cross section with respect to the perpendicular bisector of the respective side.

5. The large-size circulating fluidized bed boiler according to claim 4, wherein, in the cross section, the two cyclones of each group of cyclones are arranged back to back and close to each other on the respective side.

6. The large-size circulating fluidized bed boiler according to claim 1, wherein n is an odd number; and wherein the at least two groups of cyclones comprises three groups of cyclones or six groups of cyclones.

7. The large-size circulating fluidized bed boiler according to claim 6, wherein the at least two groups of cyclones comprises three groups of cyclones with each group having two cyclones.

8. The large-size circulating fluidized bed boiler according to claim 7, wherein the inlet flue passages of the two cyclones of each group of cyclones are axially symmetric in the cross section with respect to the perpendicular bisector of the respective side.

9. The large-size circulating fluidized bed boiler according to claim 8, wherein, in the cross section, the two cyclones of each group of cyclones are arranged back to back and close to each other on the respective side.

10. The large-size circulating fluidized bed boiler according to claim 8, wherein, in the cross section, the two cyclones of each group of cyclones are arranged opposite to each other at locations of the respective side adjacent to corners of the furnace, respectively.

11. The large-size circulating fluidized bed boiler according to claim 1, wherein the water cooling column is provided with secondary air ports through which secondary air from an internal space of the water cooling column enter into the furnace.

12. The large-size circulating fluidized bed boiler according to claim 11, wherein in the furnace cross section, the cross section of the water cooling column is axially symmetric with respect to the perpendicular bisector of each side of the polygon.

* * * * *